United States Patent [19]

Barnett

[11] 4,241,862

[45] Dec. 30, 1980

[54] BOX SEALING DEVICE

[76] Inventor: Harry Barnett, 2990 SW. 22nd St., Fort Lauderdale, Fla. 33312

[21] Appl. No.: 29,453

[22] Filed: Apr. 12, 1979

[51] Int. Cl.[3] ..... B25C 7/00

[52] U.S. Cl. ..... 227/155; 493/119

[58] Field of Search ..... 227/5, 6, 7, 152, 155; 93/39 R, 40, 41, 41.1

[56] References Cited

U.S. PATENT DOCUMENTS

| | | | |
|---|---|---|---|
| 2,208,259 | 7/1940 | Harred | 227/155 X |
| 2,226,598 | 12/1940 | Wright | 227/155 X |
| 2,347,908 | 5/1944 | Hoffert | 227/155 X |
| 2,391,488 | 12/1945 | Spiller et al. | 227/155 X |

*Primary Examiner*—Paul A. Bell

*Attorney, Agent, or Firm*—Malin & Haley

[57] ABSTRACT

A box sealing apparatus on which a box with the bottom flaps folded is positioned on an anvil-type holder supported on a moveable arm. The folded box is then manually pushed into contact with a sealing mechanism. The sealing mechanism has a contacting face that is angularly displaced from the horizontal so that the anvil-type holder has an identical angular position when the anvil holder contacts the contacting face. After the box flaps are sealed, the holder with the sealed box thereupon is returned to the operator by gravitational force for removal of the sealed box.

4 Claims, 3 Drawing Figures

BOX SEALING DEVICE

BACKGROUND OF THE INVENTION

This invention relates generally to improvements in the sealing of cartons and more particularly to an improved apparatus for sealing one end of a carton while the other end is left open.

In the past, box folding and sealing machines have been comprised either of complicated machines with linkages, gear mechanism and other various moving parts or machines with various foot operated controls. If a problem arose in any one of the many integrated moving parts of a complicated machine, the entire machine had to be shut down for repairs. The foot operated machines had a box holding platform or pedestal upon which a box was placed and then the operator moved the box to various positions to be sealed. These machines required the use of the operator's foot to bring the platform into the sealing position and required holding the platform in position with one foot in an awkward position while sealing.

SUMMARY OF THE INVENTION

The present invention relates to a new and improved apparatus for sealing one end of a carton. The present invention has a minimum of moving parts and is portable and non-complex for ease of maintenance and operation in fixed or in field-type environments.

The box sealing apparatus comprises a base member for supporting the apparatus, a sealing member connected to the base for stability, and a movable platform for holding a folded box to be sealed thereupon. The movable platform includes an anvil when used with separate anvil-type stapling device, and cavities or apertures in the platform when a retractible or self-contained type of stapling device is used. The moveable platform is connected to a pivot arm which is generally at rest at an acute angle from the vertical. When the pivot arm is in the at rest position, an open box is placed upon the generally horizontal platform which may carry anvils or cavities, and one end is folded over to a closed position generally parallel to the platform. The platform and pivot arm are then pushed by the operator to a second angular position such that the pivot arm is generally vertical. Thereupon the folded end of the inverted box positioned on the platform contacts a sealing device that is at a similar angle to that of the platform and the box thereupon is sealed. As the box contacts the sealing device, the box is sealed and the platform and pivot arm return to their first position substantially by gravitational forces, whereupon the sealed box is removed from the platform and the process may be started anew.

Accordingly, it is an object of this invention to provide a box sealing apparatus of non-complex construction in which a folded box is thrust by an operator into contact with a sealing machine for a one-stop operation that includes stopping, positioning, sealing, and allowing self return of the box positioned on the platform in and from the stapling position adjacent the stapling device.

It is another object of the present invention to provide a box holding platform that returns to the operator by means of gravitational forces.

It is still another object of the present invention to provide a sealing machine with a contacting face that is at the same angle as a box holding platform so that the two surfaces evenly mate.

It is yet another object of the present invention to provide a sealing machine that is free from foot operated controls, thereby allowing the operator to stand in a stable position when operating the machine.

In accordance with these and other objects which will be apparent hereinafter, the instant invention will now be described with particular reference to the accompanying drawings.

DESCRIPTION OF THE PREFERRED EMBODIMENT

Figure 1:
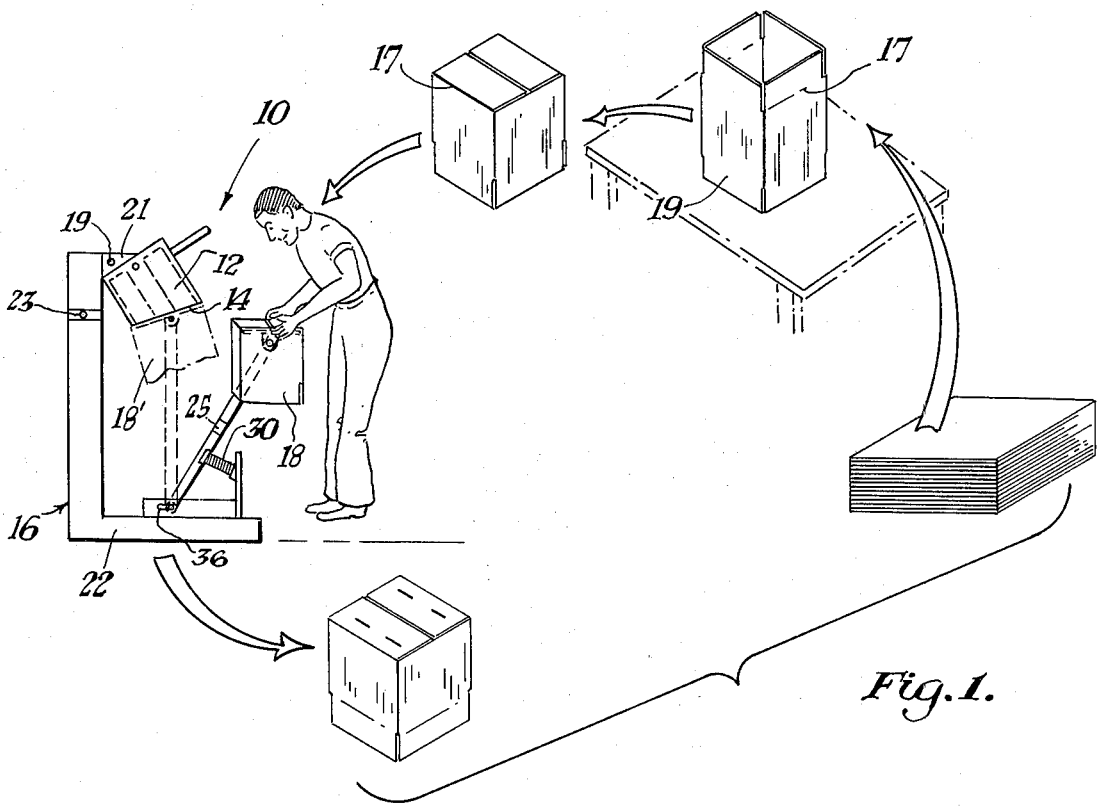
FIG. 1 is a perspective view of the present invention showing the sequence of operation.

Referring now in detail to the drawings wherein an embodiment of the invention is shown, and referring particularly to FIG. 1, the box sealing machine, generally designated as numeral 10 is illustrated. A frame 16 supports a sealing means 12, for example a stapling machine, such that a stop plate 14 is at an acute angle with the horizontal, generally 3 to 25 degrees. The frame 16 includes generally horizontal base member 22 connected to the lower end of the generally vertical member 24. The vertical member 24 may be adjusted to various heights by adjusting nut 23. The upper telescoping portion of vertical member 24 is connected to horizontally adjustable telescoping member 21 by adjusting nut 19. The adjustable sealing means or stapler 12 is connected to member 21 so that the stop plate 14 may be adjusted to different heights and different angles. After the sealing means 12 is adjusted to the proper angles by adjusting nut 15, it may be adjusted up or down along the center line of the sealing means 12 as set forth above, or may be adjusted in a horizontal plane as set forth above, all of which is to accommodate various box thicknesses and sizes.

Figure 2:
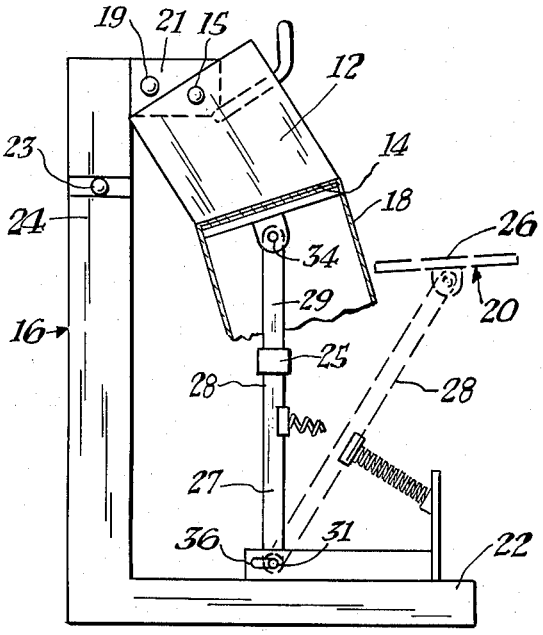
FIG. 2 is an elevational side view partially broken away illustrating the holding platform of the present invention with a folded box thereupon in contact with the stapling means.
Figure 3:
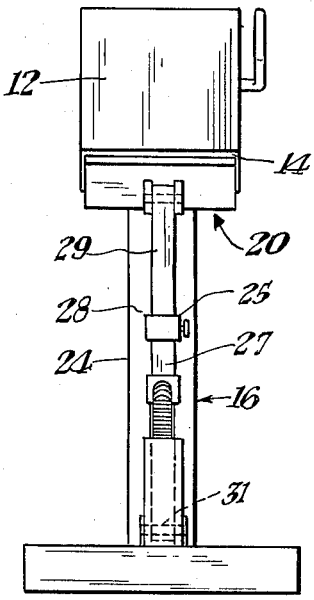
FIG. 3 is a front elevational view illustrating the present invention in a position against the stapling means.

As illustrated in FIGS. 2 and 3, a movable platform 20 is pivotably connected to the frame 16 by pivot pin 31. The movable platform 20 includes an elongated arm member 28 having its lower end 27 pivotably secured to the base member 22 and its upper end 29 connected to a holding table or anvil-type member 26. The holding table is angularly adjustable with respect to the upper end 29 by adjusting nut 34. The elongated arm member 28 may be adjusted for different lengths, for example, by adjusting collar 25, which allows the upper end 29 to slide over the lower end 27. It should be noted that platform 29 may be adjustable horizontally in slot 36. The angular position of the anvil type member or holding table 26 is adjusted so that it is generally in a horizontal plane when a box is being placed or removed therefrom, but as the elongated arm member 28 moves radially, the anvil member 26 changes angle with respect to the horizontal plane. Thus, the anvil member 26 will generally be at the same angle as the stop plate 14 when the anvil member 26 approaches the sealing means 12, that is, 5 to 15 degrees. Also, when the anvil member 26 approaches the sealing means 12, the elongated arm member 28 comes to a generally vertical position. The anvil member 26 should be adjusted so that it is generally parallel to the stop plate 14 when a box 18 is being sealed.

A biasing means 30, for example a spring, is secured to the frame 16 at one end through a plate or the like and contacts the elongated arm member 28 at the other end. The biasing means 30 aids in moving the movable platform 20 from a first position near the operator to a second position whereby the box 18 folded upon anvil member 26 contacts the stop plate 14 of the sealing 12. After contact and sealing of the folded box 18 by the sealing means 12, the moveable platform 20 moves back to a first position near the operator by gravitational force, because of balance effect obtained by placement of pivot shaft 31. Shaft 31 may be placed further to the left, as shown in FIG. 2. The pivot point 31 may be made adjustable to the left or right to provide preferred balancing of the members 27, 28, and 29.

In operation, the present invention functions as follows:

An operator takes a flat box blank and opens the box 18 as illustrated in FIG. 1, and folds the bottom lids or flaps and then places it on the anvil or platform 26 so that the inner faces of the bottom flaps are in parallel communication with the platform member 26. Then the operator thrusts the movable platform 20 having the box with folded bottom flaps thereupon, toward and against the sealing means 12, while maintaining both his feet on the ground in a stable position. As the box strikes the stop plate 14, which may be the face of sealing means 12, it is stopped, positioned, and sealed. The folded bottom flaps are stapled closed and the movable platform 20 is allowed to return by gravity back to the operator. The return may be assisted by a biasing means, such as a spring. Finally, the operator removes the box with its bottom sealed and the operation may begin again. In other words, the box sealing machine is used to seal the bottom of an inverted box by placing the box on a platform that is mounted on the distal end of a pivotal member as shown. This mounting allows the platform with the box thereon to be brought into contact with a sealing means or staple device to provide an angular mating of the box and the sealing means and provide a firm, parallel mating contact and at the same time allows unrestricted return of the platform with the sealed box thereon.

The sealing means 12 may be pnematically or electrically operated by a small combusion engine or motor, for example, for field use.

The sealing means 12 may include a plurality of stapling guns which may be adjusted both longitudinally and transversely to fasten various size boxes with various staple patterns.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A box sealing machine comprising:

a frame means for supporting said box sealing machine, said frame means having a lower portion and an upper portion, a sealing means adjustably connected to said upper portion of said frame for fastening one end of an inverted box into a closed position, a pivotal arm having a first end movably connected to said lower portion of said frame and a distal end, a platform means for supporting and positioning the inverted box, said platform means connected to said distal end, said pivotal arm and said platform means having a load position and a sealing position, said platform means is sized and shaped to receive the inverted box from an operator in said load position and fix the position of the inverted box relative to said platform means, said pivotal arm and said platform means positioned near the operator in said load position, said pivotal arm means including means for allowing movement to and return from said sealing position by the operator initially pushing the inverted box and said platform means toward said sealing means, said platform means sized and positioned to stop and position the inverted box on said platform means in contact with the sealing means without aid of the operator, after the initial push, said sealing means actuated by said inverted box and said platform means engaging said sealing means, said sealing means positioned substantially parallel to said inverted box on said platform means when stopped and sealed by sealing means in said sealing position.

2. A box sealing machine as set forth in claim 1, wherein:

said platform means is positioned substantially horizontal when said pivotal arm means is in said sealing position.

3. A box sealing machine as set forth in claim 1, wherein:

said sealing means is a stapler, said platform means includes an anvil to staple said inverted box closed in said sealing position and a positioning structure.

4. A box sealing machine as set forth in claim 2, wherein:

said pivotal arm means is positioned substantially vertical when moved to said sealing position.

* * * * *